US006195060B1

(12) United States Patent
Spano et al.

(10) Patent No.: US 6,195,060 B1
(45) Date of Patent: Feb. 27, 2001

(54) ANTENNA POSITIONER CONTROL SYSTEM

(75) Inventors: Dawson P. Spano, Valkaria; Amy J. Ostby, Melbourne; Dennis A. Green, Vero Beach, all of FL (US)

(73) Assignee: Harris Corporation, Palm Bay, FL (US)

( * ) Notice: Subject to any disclaimer, the term of this patent is extended or adjusted under 35 U.S.C. 154(b) by 0 days.

(21) Appl. No.: 09/264,923

(22) Filed: Mar. 9, 1999

(51) Int. Cl.[7] ..... H01Q 3/00

(52) U.S. Cl. ..... 343/766; 343/765; 343/757; 343/882; 248/183

(58) Field of Search ..... 343/878, 880, 343/881, 882, 765, 766, 763, DIG. 2, 757, 764; 342/35 G; 248/183; H01Q 1/32, 1/08, 13/00, 3/08

(56) References Cited

U.S. PATENT DOCUMENTS

| | | | | |
|---|---|---|---|---|
| 3,707,721 | | 12/1972 | McCartney . | |
| 3,714,660 | * | 1/1973 | Scrafford et al. | 343/757 |
| 3,893,123 | * | 7/1975 | Bieser | 343/706 |
| 4,204,214 | * | 5/1980 | Fassnacht | 343/766 |
| 4,689,635 | * | 8/1987 | Haupt | 343/894 |
| 4,760,402 | | 7/1988 | Mizuno et al. . | |
| 4,873,526 | | 10/1989 | Katsuo . | |
| 5,025,262 | | 6/1991 | Abdelrazik et al. . | |
| 5,153,485 | | 10/1992 | Yamada et al. . | |
| 5,227,806 | | 7/1993 | Eguchi . | |
| 5,337,062 | | 8/1994 | Sherwood et al. . | |
| 5,419,521 | | 5/1995 | Matthews . | |
| 5,420,598 | | 5/1995 | Uematsu et al. . | |
| 5,689,276 | | 11/1997 | Uematsu et al. . | |
| 6,008,769 | * | 12/1999 | Palmiter et al. | 343/766 |

* cited by examiner

*Primary Examiner*—Tho Phan
(74) *Attorney, Agent, or Firm*—Allen, Dyer, Doppelt, Milbrath & Gilchrist, P.A.

(57) ABSTRACT

An antenna positioner control system and related method is disclosed. The antenna positioner control system includes a housing and a hub mounted within a housing. A support plate is rotatably mounted on the hub. An antenna is pivotally mounted on the support plate. At least one elevation drive servomotor is mounted on the support plate and interconnects the antenna for pivoting the antenna a predetermined angle and adjusting elevation of the antenna. At least one azimuth drive servomotor is mounted on the support plate and interconnects the antenna for rotating the support plate relative to the hub a predetermined arcuate distance for adjusting azimuth of the antenna. An antenna control unit is operatively connected to the elevation drive servomotor and azimuth drive servomotor and includes an elevation control circuit and azimuth control circuit. Each of the control circuits include a position feedback control loop, a resolver positioned within the position feedback control loop, a rate feedback control loop, a tachometer positioned within the rate feedback control loop, and a motor feedback control loop.

28 Claims, 14 Drawing Sheets

TPO-4
TPO-3
TPO-2
TPO-1
124
D/A (5604-6)
D/A (5604-5)
D/A (5408-2)
D/A (5408-1)
TPI-3
TPI-2
TPI-1
128
A/D (5408-3)
A/D (5408-2)
A/D (5408-1)
123
102
(SWITCH)
TACH COMP (w) LIMITED INTEGRATOR
88
RFF COMMAND
RATE LIMITER
126
POSITION COMP (w) LIMITED INTEGRATOR
86
94
RS-422 +
EL POSITION COMMAND

ANTENNA POSITION
$\phi_L$
62
ANTENNA
66
MOTOR
-1 TO 1 A
122
CURRENT COMP
90
TPO-5
DRIVE AMP
108
125
LOW-PASS FILTER
-1 TO 1 V
1 TO -1 V
124
D/A (5604-5)
D/A (5604-6)
124
-1

TACHOMETER
104
-0.13 TO 0.13 V
100
130
ANTI-ALIASING FILTER AND LIMITER
96
RESOLVER
132
8.5 V SIN(θ_L)
8.5 V COS(θ_L)
8.5 V, 1000 Hz
2
2
2
128
A/D (5408-4)
128
A/D (5408-5)
-1
R/D W/ REFERENCE
(REFERENCE)
120
134
MUX DIFFERENTIATOR
D/A (5604-8)
124
TP0-7
124
D/A (5604-7)
TP0-6
RATE FEEDBACK
POSITION FEEDBACK
92
ANTENNA CONTROL UNIT
82

TPO-1
TPO-2
TPO-3
TPO-4
124'
D/A (5604-5)
D/A (5604-6)
D/A (5604-5)
D/A (5604-6)
TPI-1
TPI-2
A/D (5408-6)
A/D (5408-7)
128'
128
86
POSITION COMP
(w) LIMITED INTEGRATOR
TACH COMP
(w) LIMITED INTEGRATOR
88'
123'
RFF COMMAND
RATE LIMITER
(SWITCH)
(SWITCH)
(SWITCH)
126'
RS-422 +
AZ POSITION COMMAND

TPI-3
128'
A/D (5408-8)
123'
124'
D/A (5604-1)
-1 TO 1 V
-1
1 TO -1 V
D/A (5604-2)
124'
125'
LOW-PASS FILTER 1
TORQUE BIAS
DRIVE AMP 1
122'
TPO-5
CURRENT COMP 1
90'
-1 TO 1 A
MOTOR 1
56
TPI-4
A/D (5408-9)
123a'
124'
D/A (5604-3)
-1 TO 1 V
-1
1 TO -1 V
D/A (5604-4)
124'
125a'
LOW-PASS FILTER 2
TORQUE BIAS
DRIVE AMP 2
122a'
TPO-5
CURRENT COMP 2
90a'
-1 TO 1 A
MOTOR 2
58'
62
ANTENNA
ANTENNA POSITION
$\theta_L$ TACH 2
104a'
TACH 1
104
-1.71 TO 1.71 V
-1.71 TO 1.71 V
130a'
130'
ANTI-ALIASING FILTER AND LIMITER
ANTI-ALIASING FILTER AND LIMITER
A/D (5408-10)
A/D (5408-11)
A/D (5408-12)
A/D (5408-13)
-1
-1
134a'
134'
MUX DIFFERENTIATOR
MUX DIFFERENTIATOR
RATE FEEDBACK
RATE FEEDBACK
126
(SWITCH)
126
(SWITCH)

96'
RESOLVER
8.5 V SIN(θ'L)
8.5 V COS(θ'L)
8.5 V, 1000 Hz
2
2
2
R/D W/ REFERENCE
(REFERENCE)
120'
124'
D/A (5604-8)
TP0-9
D/A (5604-7)
TP0-8
124'
D/A (5604-7)
TP0-7
124'
POSITION FEEDBACK
92'
ANTENNA CONTROL UNIT

ANTENNA POSITIONER CONTROL SYSTEM

FIELD OF THE INVENTION

This invention is related to antenna positioners, and more particularly, this invention is related to an antenna positioner control system.

BACKGROUND OF THE INVENTION

Direct broadcast satellite (DBS) signals are often transmitted to aircraft and other moving vehicles. These transmitted signals are often KU-band television signals that are transmitted to commercial aircraft, trains and other moving vehicles, and are typically UHF and VHF band signals, which can be received on small antennas, such as the common 18" disks placed on the sides of houses. The antenna can also be formed as a phased array antenna, and designed as a flat plate, as is known to those skilled in the art. Many different types of housings and positioners have been designed to point the antenna's main beam at the desired direct broadcast satellite while an aircraft maintains various commercial cruise flight dynamics. These dynamics include a role of 5°/second and 5°/second$^2$; a pitch of 5°/second and 3°/second$^2$; and a yaw of 5°/second and 5°/second$^2$.

One current method has been to use a mechanical device with an in-line jack screw actuator for elevation and a direct drive azimuth. In most types of controls, an antenna controller receives position commands and directs movement of various motors. However, these type of requirements are not adequate because with a mechanical system, the slew rate is slow and motors often overheat in maintaining positions. Also, the controller does not include a rate feed forward, which is desirable. Also, many prior art antenna positioners have mechanical designs that allow control over azimuth and elevation, but the motors and drive mechanics have excessive backlash. Also, many prior art designs do not fit into low profile housings that are adapted for mobile applications, such as mounting on the fuselage of an aircraft.

U.S. Pat. No. 5,025,262 to Abdelrazik et al. discloses a pedestal with a helical element antenna that is mechanically steered with reference to an azimuth axis and elevation axis. A mechanical steering system includes a supporting frame having an azimuth member and an elevation member that is integral with the azimuth member. It includes a longitudinal axis displaced from the azimuth axis.

U.S. Pat. Nos. 5,689,276 and 5,420,598 to Uematsu et al. disclose an antenna housing for a satellite antenna device, which mounts on a moving body and includes an automatic tracking mechanism. An elevation motor is fixed to a rotary base. A series of pulleys and shafts act as a driving mechanism. A rack has teeth formed along a circle about the rotating axis in elevation direction of the antenna unit A. The teeth of the rack mesh with the pinion gear to be driven circumferentially by the driving torque transmitted to a pinion gear. Thus, the antenna unit is driven for rotation in the elevation direction. An azimuth motor is fixed on the rotary base. Through a sufficient pulley mechanism, the driving torque of the azimuth motor is transmitted to the pinion, which meshes with teeth of a belt such that the driving torque of the azimuth motor is transmitted through the pulleys.

U.S. Pat. No. 5,153,485 to Yamada et al. discloses a high gain antenna that is mounted on board an automobile for reception of satellite broadcasting. The system uses a beam antenna in the form of a flat plate that is secured to an antenna bracket. A turntable has a disk-shaped spur gear that includes a gear around its lateral side. Turntables are rotatably mounted on a stationary base by a bearing. Reduction gearing in a motor is mounted on the support plate and secured to a stationary plate base. The beam antenna can be moved in both azimuth and elevation.

Many of these systems suffer some of the drawbacks noted above.

SUMMARY OF THE INVENTION

It is therefore an object of the present invention to provide an antenna positioner control system that allows adequate control over elevation and azimuth with a rate forward.

It is still another object of the present invention to provide an antenna positioner control system that allows adequate control over elevation and azimuth with adequate command signaling and control.

In accordance with the present invention, an antenna positioner control system includes a housing and a hub mounted within the housing. A support plate is rotatably mounted on the hub. An antenna is pivotally mounted on the support plate. At least one elevation drive servomotor is mounted on the support plate and interconnects the antenna for pivoting the antenna a predetermined angle and adjusting elevation of the antenna. At least one azimuth drive servomotor is mounted on the support plate and interconnects the antenna for rotating the support plate relative to the hub a predetermined arcuate distance for adjusting azimuth of the antenna.

An antenna control unit is operatively connected to the elevation drive servomotor and the azimuth drive servomotor. The antenna control unit includes an elevation control circuit operatively connected to the elevation drive servomotor for adjusting elevation and an azimuth control circuit operatively connected to the azimuth drive servomotor for adjusting the azimuth angle of the antenna. Each of the control circuits includes a position feedback control loop and a resolver positioned within each position feedback control loop. Each control circuit also includes a rate feedback control loop and a tachometer positioned within the rate feedback control loop. Also included is a motor feedback control loop within each circuit.

In one aspect of the present invention, a current compensator is positioned within the motor feedback control loop. A position compensator is also positioned within a position feedback control loop. A tachometer compensator can be positioned within the rate feedback control loop.

In still another aspect of the present invention, an antenna subsystem controller is operatively connected to the antenna control unit. The antenna subsystem controller further comprises a circuit for generating azimuth and elevation pointing commands to the antenna control unit. The antenna can include a phased array antenna. An antenna support shaft can be mounted on the antenna such that rotation of the support shaft pivots the antenna and adjusts elevation. The elevation servomotor can be operatively connected to the support shaft. The elevation drive servomotor can include an output shaft and a drive mechanism operatively interconnecting the output shaft and drive shaft.

In still another aspect of the present invention, the antenna control unit includes a circuit for generating a rate feed forward command to each of the azimuth drive and elevation drive servomotors corresponding to an anticipated velocity position.

A method aspect of the present invention is also disclosed. The method controls azimuth and elevation of an antenna and comprises the step of providing a hub mounted within a housing, a support plate rotatably mounted on the hub. The antenna is pivotally mounted on the support plate. The method comprises the step of generating an azimuth pointing command and elevation pointing command within respective azimuth and elevation control circuits to respective azimuth and elevation drive servomotors. The respective azimuth and elevation drive servomotors are driven through respective azimuth and elevation current acceleration loops. The azimuth and elevation voltage commands are generated to the respective current acceleration loops through respective tachometer rate loops that are closed about respective azimuth and elevation tachometers. The respective azimuth and elevation velocity commands are generated to the respective tachometer rate loops through respective azimuth and elevation position loops.

In still another aspect of the present invention, the method includes the step of closing the respective azimuth and elevation position loops about the tachometer rate loops through the use of resolvers. The method also includes the step of generating a rate feed forward command to increase the responsiveness of the respective circuits by bypassing a lower bandwidth position loop and injecting a command directly into a higher bandwidth tachometer rate loop.

BRIEF DESCRIPTION OF THE DRAWINGS

Other objects, features and advantage of the present invention will become apparent from the detailed description of the invention which follows, when considered in light of the accompanying drawings in which.

DETAILED DESCRIPTION OF THE PREFERRED EMBODIMENTS

The antenna controller of the present invention is advantageous because the antenna fits within a low profile housing and can point the antenna's main beam at a chosen direct broadcast satellite, while an aircraft maintains typical commercial cruise flight dynamics. The antenna positioner allows control of the positioner on a moving platform and has anti-backlash capability through its efficient mechanical design. The positioner can be used with a dish, flat array or phased array antenna.

Figure 1:
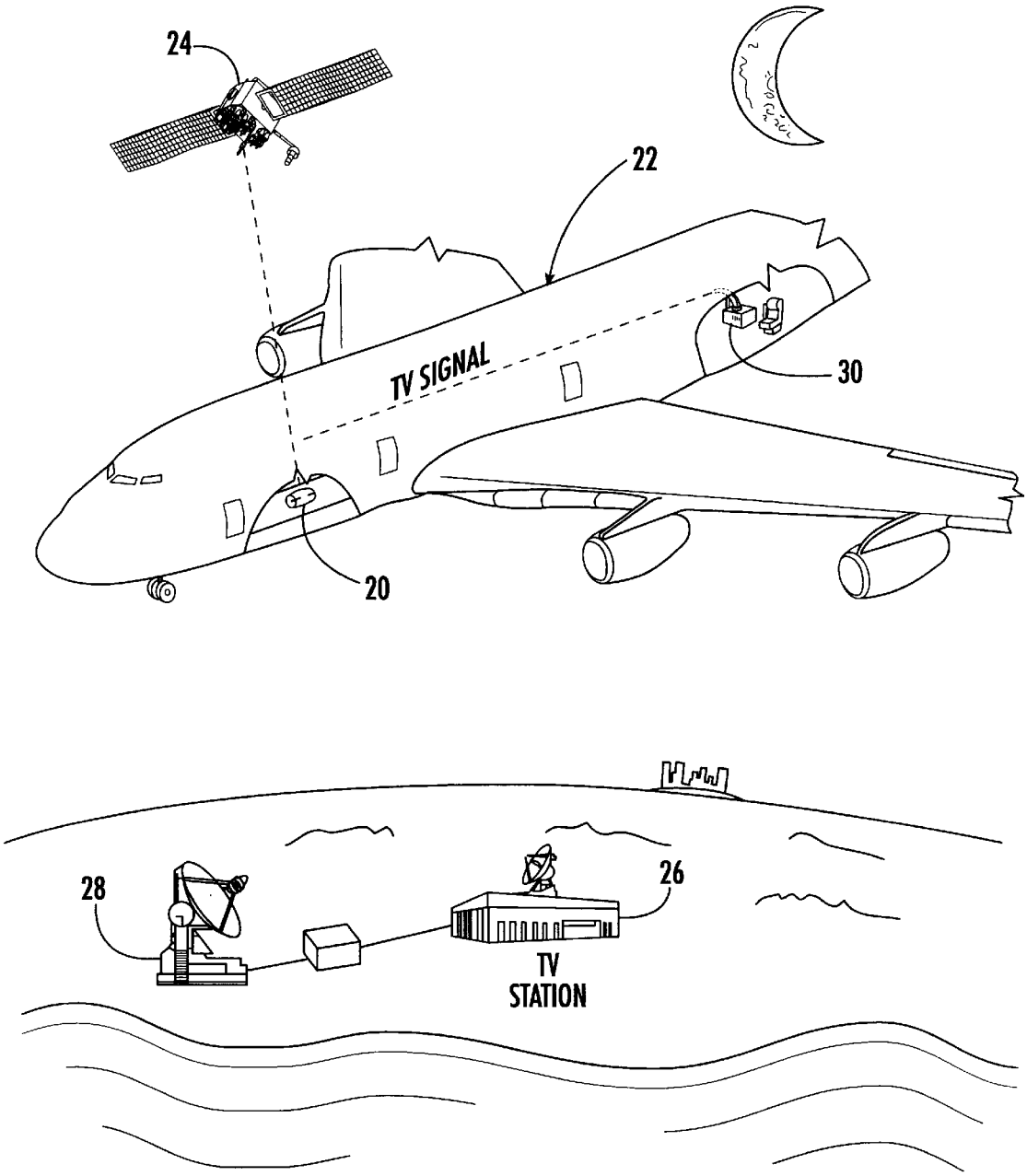
FIG. 1 is an overall perspective view of an aircraft showing one example of an antenna positioner of the present invention mounted on the underside of the aircraft, which receives satellite signals that originate from a TV station and satellite up link.

As shown in FIG. 1, the antenna positioner of the present invention is illustrated at 20, and shown mounted on the underside of an aircraft 22. A direct broadcast satellite (DBS) 24 initially receives signals from a TV station 26 and its satellite dish 28. The antenna positioner 20 adjusts its azimuth and elevation to point the antenna beam and receive KU-band television signals, which are then processed and forwarded throughout the aircraft for display over an aircraft television terminal 30 as shown in the drawing.

Figure 2:
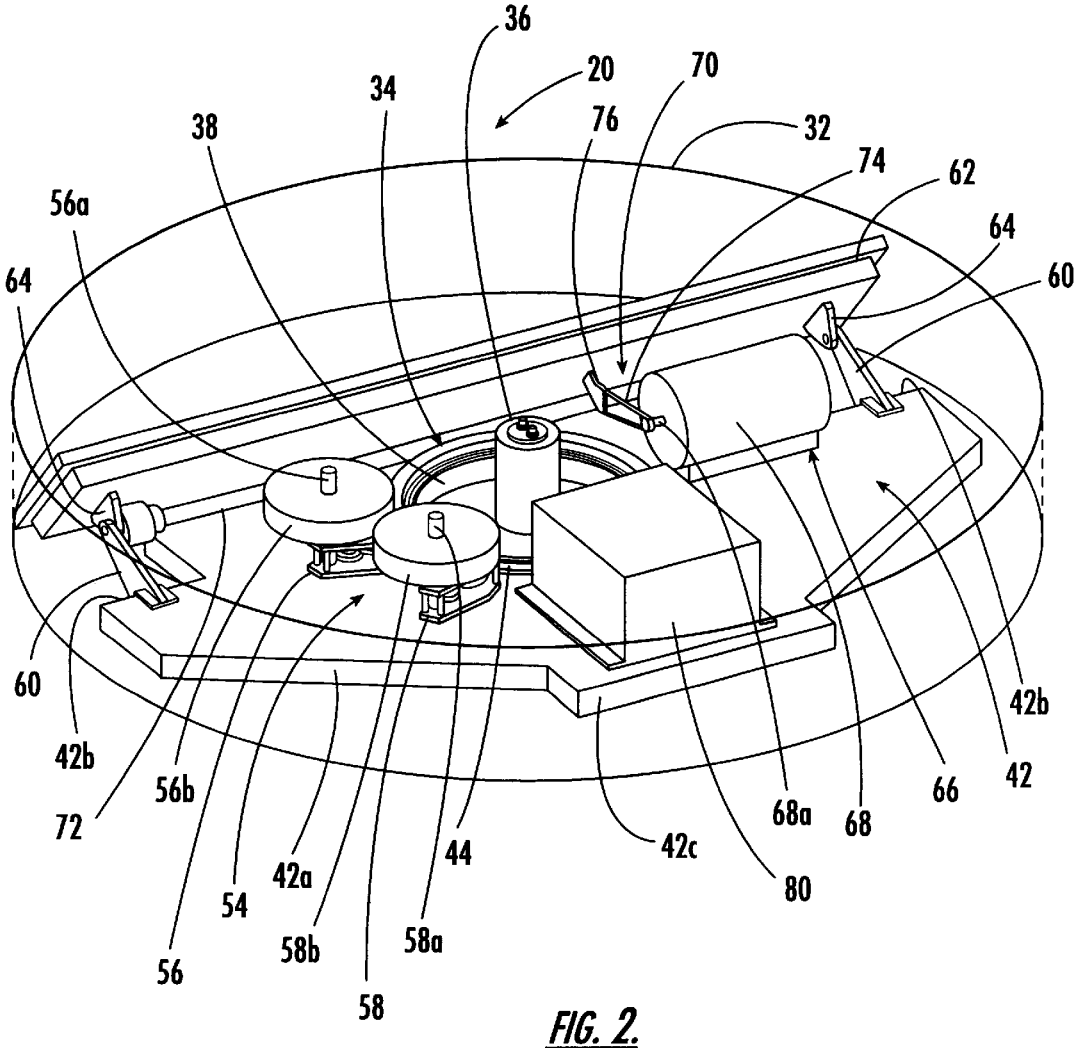
FIG. 2 is a schematic, isometric view of one example of the antenna positioner of the present invention, showing basic components of the housing, hub, support plate, antenna, controller and elevation and azimuth drive mechanisms.
Figure 3:
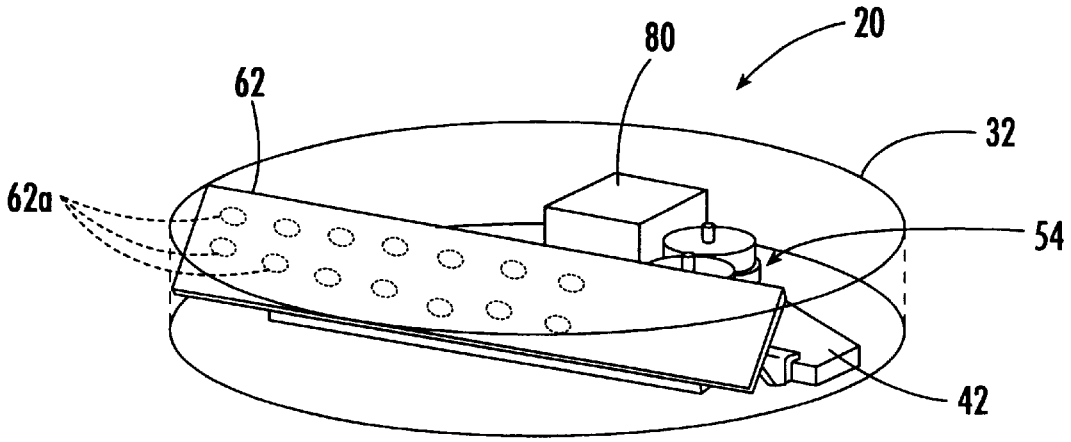
FIG. 3 is another isometric view of the antenna positioner similar to FIG. 2, but showing the front side of a flat panel, phased array antenna.

The antenna positioner 20 includes a housing 32 as shown in FIG. 2. The housing 32 is preferably annular configured and has a diameter at least twice the height of the housing as shown in FIG. 2. The housing 32 can be formed from many different materials as known to those skilled in the art, including a resin plastic that is preformed or premolded, metal, or fiber impregnated substances, such as an epoxy. The housing 32 should be strong to withstand shock and excessive mechanical forces. When an antenna that is designed to receive KU-band signals is used with the housing, a typical diameter of the housing 32 can be about 34 inches. This type of annular design is only one example of a housing 32 that can be used in the present invention and other designs can be used as suggested by those skilled in the art. However, the annular design is advantageous because it is well adapted to mobile applications and for breaking wind with its aerodynamic, annular design.

Figure 4:
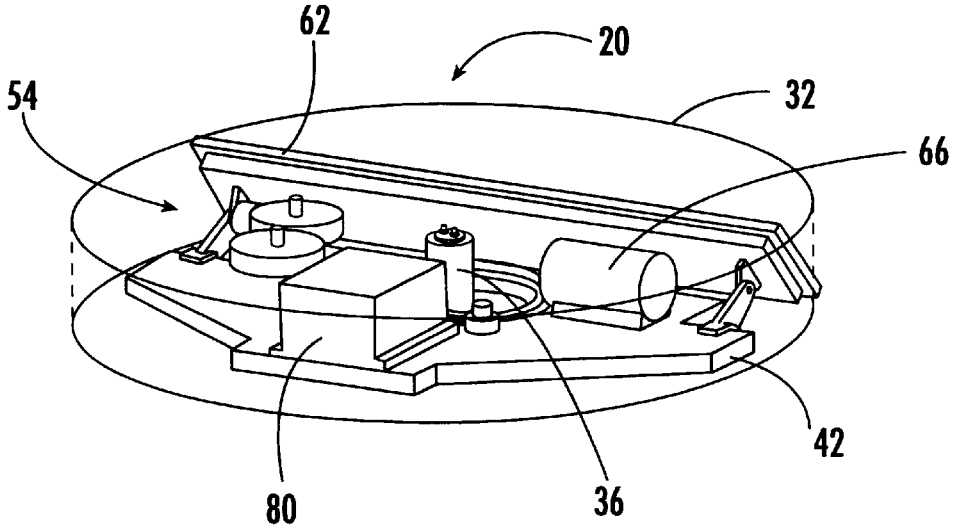
FIG. 4 is another isometric view of the antenna positioner similar to FIG. 2.
Figure 5:
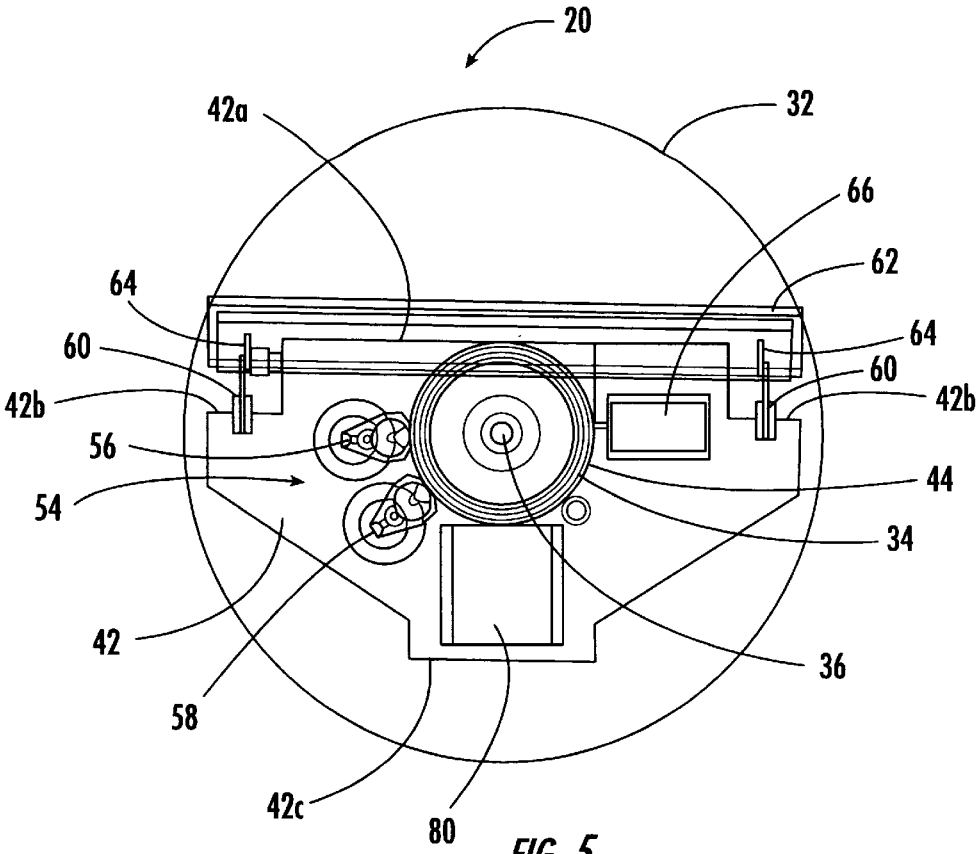
FIG. 5 is a top plan view of the antenna positioner of FIG. 2.
Figure 6:
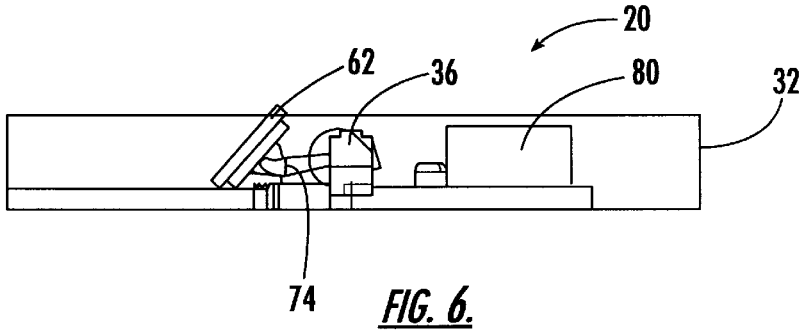
FIG. 6 is a side elevation view of the antenna positioner of FIG. 2.
Figure 7:
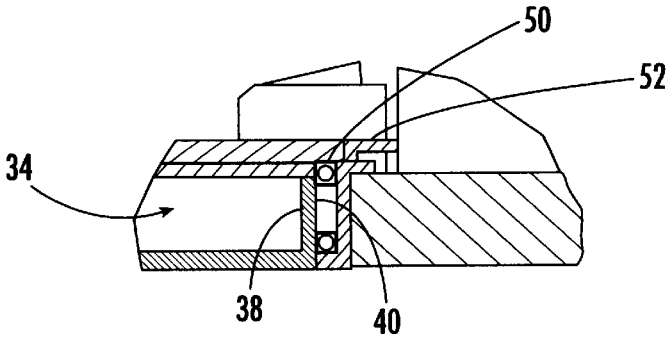
FIG. 7 is a partial schematic, enlarged side elevation view of the antenna positioner, and showing the inner and outer bearing races and the ring gear.

As shown in FIGS. 2, 4 and 5, a control hub 34 is mounted within the housing. The hub 34 includes a generally cylindrical spindle 36 forming the central portion of the central hub. The hub 34 is substantially annular configured and includes an outer peripheral wall 38 spaced from the spindle axis. The wall 36 includes an inner bearing race 40 (FIG. 7). As shown in FIG. 7, the hub 34 is shaped somewhat as a dish with the central spindle axis and the outer upstanding wall 38 that forms a part of the inner bearing race 40. As shown in FIG. 5, the spindle axis 36 forms the central point of the housing diameter within the annular configured housing 32.

A substantially planar configured support plate 34 is rotatably mounted on the central hub within the annular configured housing 32. As shown in FIGS. 2 and 5, the support plate 42 is formed similar to a truncated triangular configured design and formed as a plate with a central opening 44 that is received over the annular configured central hub 34. The central opening 44 has an inner wall 46 forming an annular configured support mount, having an outer bearing race 48 that cooperates with the inner bearing race 40 formed on the annular configured central hub 34. Ball bearings 50 are positioned with the ball bearing channel formed by the races 40, 48. The ball bearings 50 can be kaydon type C KA series bearings having a starting torque of 70 inch-ounces at −50° F. with factory "cut" grease. The running torque is about 70"-ounces. The races 40, 48 can also be formed by bonding a metallic race to the edges of the support plate and central hub. Although one illustrated design has been described, other designs could be used as suggested by those skilled in the art. The support plate 42 with this type of race and ball bearing assembly is easily moveable relative to the central hub 34.

A ring gear 52 is positioned on the central hub 34. An azimuth drive mechanism 54 is mounted on the support plate 42 and engages the ring gear 52 to drive same, and thus rotate the support plate 42 a predetermined arcuate distance. As illustrated in the figures, the azimuth drive mechanism, in one preferred aspect of the invention, is designed as two servomotors 56, 58, each having an output shaft 56*a*, 58*a* and pinion gear 56*b*, 58*b* mounted thereon, which engage the ring gear 52 for rotating the support plate 42 relative to the central hub 34 and housing 32 a predetermined arcuate distance on the central hub 34 for adjusting azimuth of the antenna. The two servomotors 56, 58 are advantageous because backlash is minimized when two servomotors are used to adjust azimuth. The ring gear 52 and pinion gears 56, 58 in one aspect of the present invention establish about a 16:1 gear reduction ratio. Although many different types of servomotors can be used, the typical azimuth drive mechanism that has been found acceptable uses two DC brushed motors that are torque-biased to mitigate backlash. It has been found advantageous to use Kollmorgen N9M4T ServoDisk motors. The gear heads can be fabricated by techniques known to those skilled in the art and can have a 6.5:1 structural reduction ratio.

As illustrated in FIGS. 2 and 5, the longer end of the support plate 42 forming the hypotenuse 42*a* has two edge cutouts 42*b* on which are positioned antenna mounts 60 forming hinges to support an antenna 62, which in one preferred aspect, is formed as a flat panel plate and phased array antenna having a plurality of individual antenna elements 62*a*. The antenna 62 in the illustrated aspect of the invention is rectangular configured. However, different antenna configurations can be used as known to those skilled in the art.

As illustrated, the antenna 62 is substantially elongate and rectangular configured and pivotally mounted on the support plate 42. It extends across a substantial portion of the housing 32 defined by a chord having a length about the diameter of the housing. Support tabs 64 extend from the rear side of the antenna 62 and form the pivot connection with the mounts 60 that are positioned on the cutouts 42*b*.

An elevation drive mechanism 66 is mounted on the support plate 42 and interconnects the antenna 62 for pivoting the antenna a predetermined angle and adjusting elevation of the antenna 62. As illustrated in FIG. 2, the elevation drive mechanism 66 includes a servomotor 68 having an output shaft 68*a*. A drive mechanism 70 interconnects the shaft 68*a*, and connects to a shaft 72 that extends along the rear side of the antenna. The shaft 72 couples to the pivoting hinge of the antenna at the intersection of the antenna mount 60 and support tab 64. The drive mechanism 70 forms a pull/pull drive design to minimize backlash. In one illustrated aspect of the invention, the pull/pull drive is formed by thick cables 74 that interconnect a pull/pull tab 76, similar to a pulley type of design arrangement. Thus, the elevation servomotor 68 is exactly controlled and the preferred amount of arcuate output shaft rotation allows exact elevation movement of the antenna. The elevation drive mechanism can be formed from a single DC brushed motor, such as a Kollmorgen accurex S6M4H/86060, with a backlash free gear head having a 60:1 reduction ratio. A structural reduction ratio of 2:1 has been found acceptable.

To minimize backlash by reducing component weight, the various components, such as the support plate 42, can be formed from a lightweight material, such as a honeycomb structure, typically formed as an expanded plastic. Other materials could include lightweight metals and other materials known to those skilled in the art.

The present invention is also advantageous because it allows adequate antenna positioner control using a controller 80 mounted on the support plate, such as on its rear end 42*c* opposite the hypotenuse 42*a*. The controller 80 is operatively connected to the elevation drive mechanism and azimuth drive mechanism, and controls the azimuth and elevation drive mechanisms and adjusts elevation and azimuth.

Figure 8:
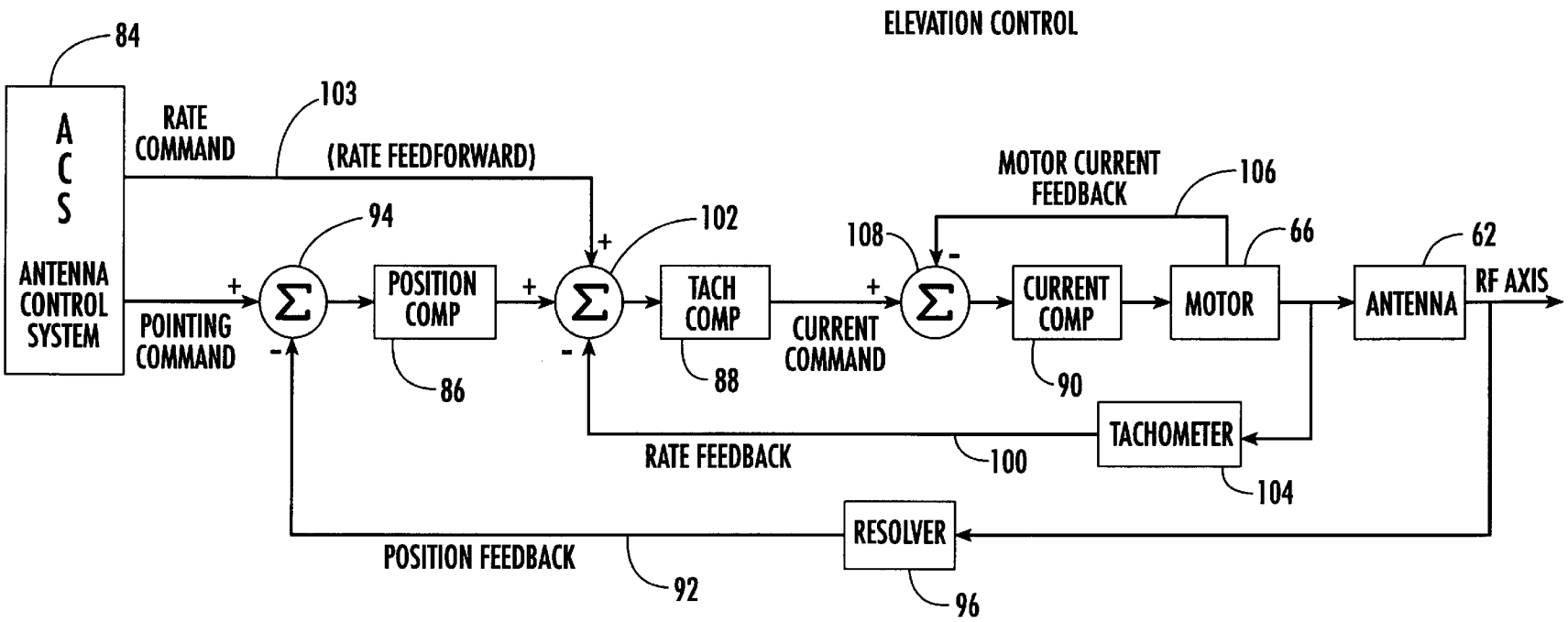
FIG. 8 is a schematic block diagram of the elevation control circuit of the present invention.
Figure 9:
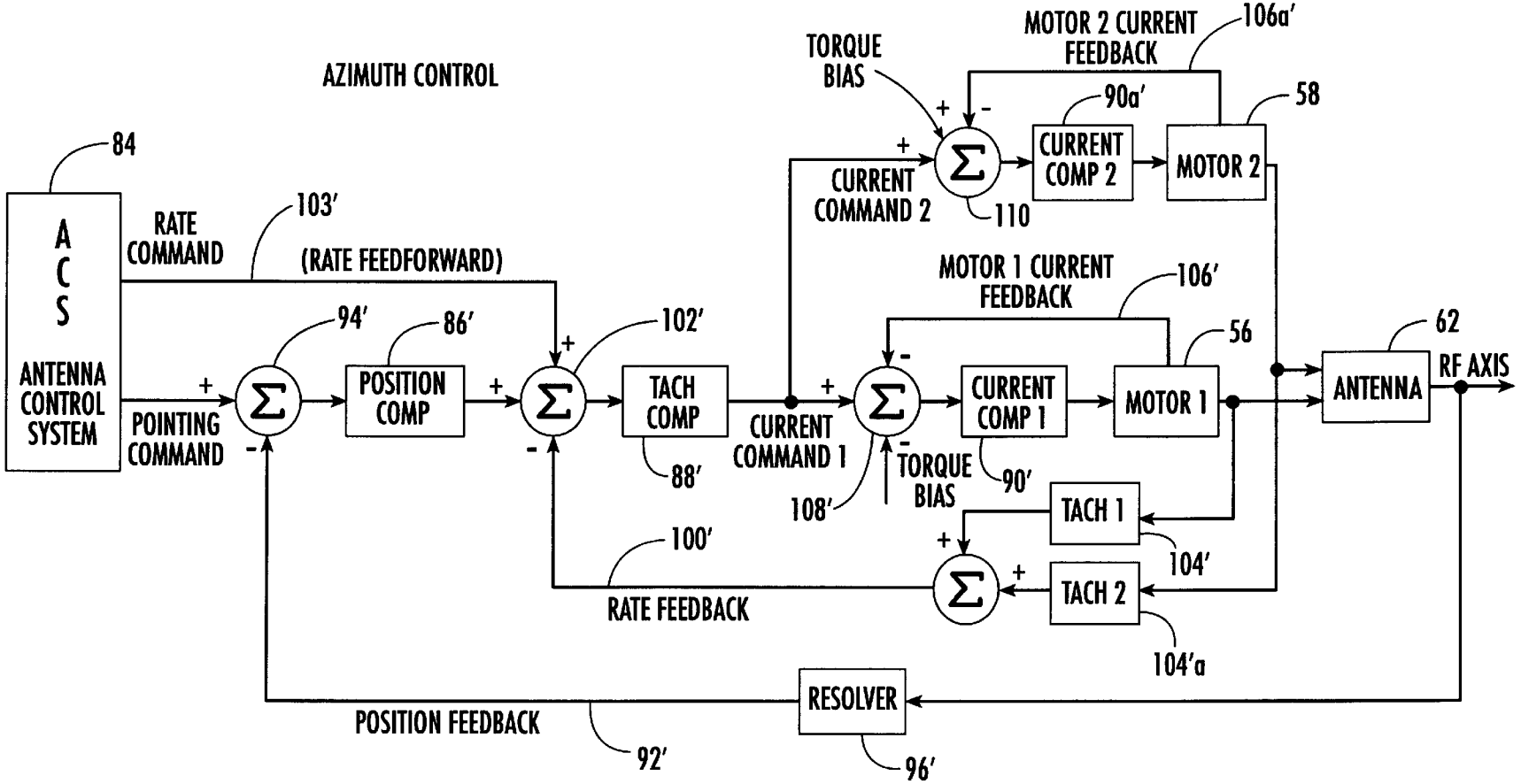
FIG. 9 is a schematic block diagram of the azimuth control circuit of the present invention.
Figure 10:
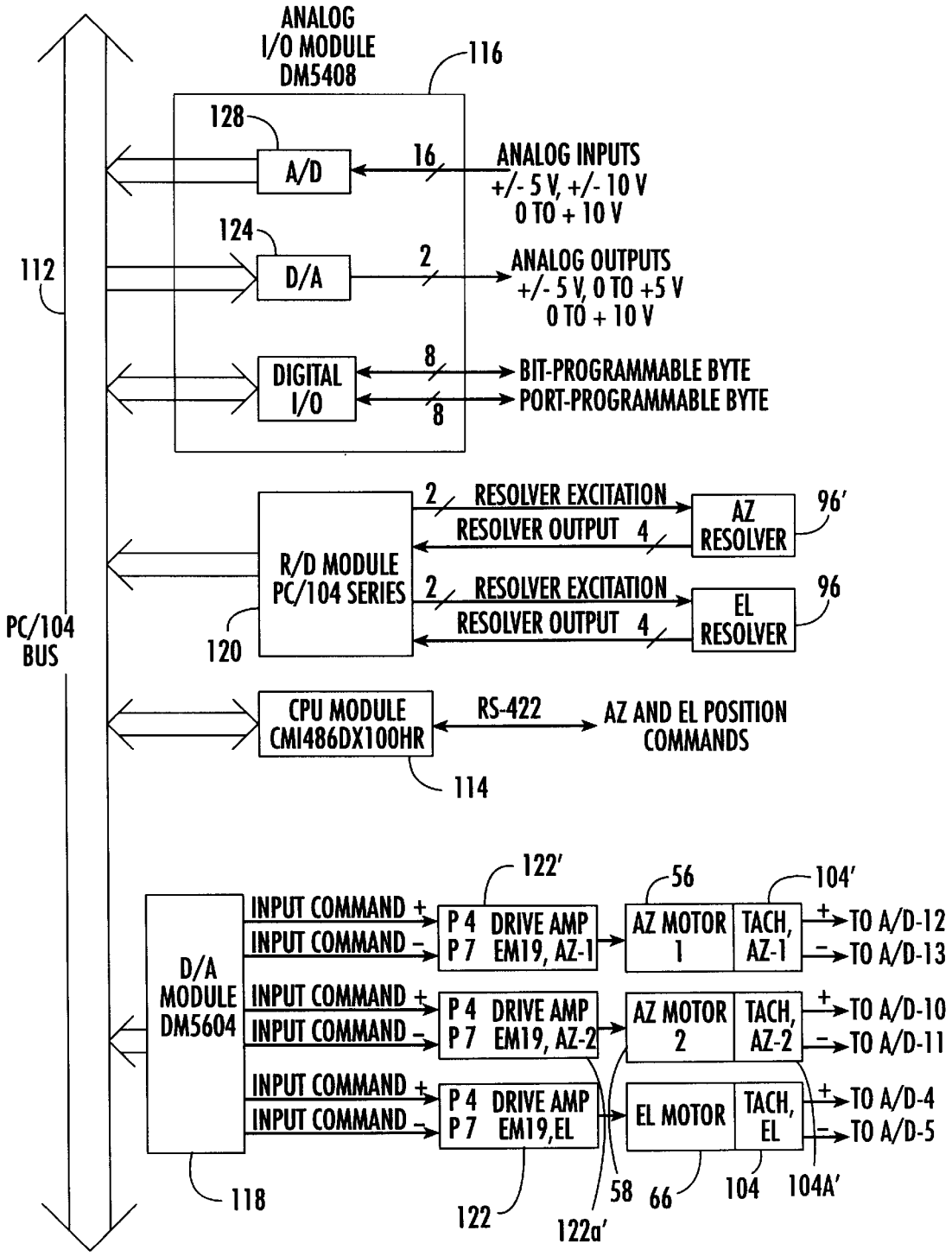
FIG. 10 is a block diagram of the antenna control unit that includes the basic azimuth and elevation control circuits.

The controller 80 includes an antenna control unit 82 that is operatively connected to the elevation drive servomotor 68 and azimuth drive servomotors 56, 58 (FIGS. 8–10). As shown in FIG. 8, the antenna control unit 82 includes an elevation control circuit operatively connected to the elevation drive servomotor for adjusting elevation. Elevation pointing commands are generated by an Antenna Control System (ACS) and into the circuit having a position compensator 86, tachometer compensator 88 and current compensator 90 and then to the elevation drive servomotor 68. As illustrated, the elevation control circuit includes a position feedback control loop 92, which allows position feedback of antenna movement. This loop 92 extends to an input before the position compensator 86 into a mixer/summer 94 where the pointing command originally is input. A resolver 96 is positioned within the position feedback control loop 92. The resolver 96 can be a Computer Conversion Corporation, RN0-11HB, size 11 with an input voltage of 8.5 volts and 1,000 HZ. Although this is only one type of resolver, other resolvers can be used as known to those skilled in the art.

As illustrated, a rate feedback control loop 100 extends from the elevation servomotor 68 to a mixer/summer 102 that is positioned after the position compensator 86 and before the tachometer compensator 88. A rate feed forward command 103 generated by the Antenna Control System 84 is received into the mixer/summer 102. A tachometer 104 is positioned within the rate feedback control loop 100. A motor feedback control loop 106 extends from the motor 68 to a mixer/summer 108 positioned between the tachometer compensator 88 and current compensator 90. The motor feedback control loop 106 also acts as a current or acceleration loop, and can also be referred to by this term.

As shown in FIG. 9, the azimuth control circuit includes similar components, such as a position compensator, tachometer compensator and current compensator and the mixer/summers, which are given the same reference numeral except with the addition of the prime notation a. Second elements are given the reference numeral the same as the first, except the addition of a letter a. One key difference is that two azimuth servomotors are used and referred to as motor 1 and motor 2. Thus, there is a second motor feedback control loop 106*a* and a second tachometer 104*a* positioned within the rate feedback control loop. Additionally, the summer/mixer 108 includes a torque bias input. Also, a second motor feedback control loop 106*a* is included, and includes a second current compensator 90*a* and mixer/summer 110 that receives inputs from mixer/summer 108.

FIG. 10 illustrates another block diagram of the antenna control unit 82 of the present invention, which includes the control circuits as described above. The antenna control unit 82 includes four main modules that connect into a bus 112, such as a PC/104 bus. A first CPU module 114 is formed as a real time device and typically could include at least two RS-422 serial ports for receiving the azimuth and elevation position commands. An analog input/output module 116 is also formed as a real time device. A digital-to-analog module 118 is also formed as a real time device. A resolver-to-digital module (R/D) 120 can be formed, such as by a Computer Conversion Corporation's PC 104-AMAM-3WRHB circuit.

This resolver-to-digital module 120 provides resolver excitation, such as 8.5 volts at 1,000 HZ.

The modules can be enclosed by a ruggedized box with a power supply. One example is a Kinetic Computer Corporation RCC-104. The antenna control unit 82 receives pointing commands via the RS-422 serial interface and commands the elevation and azimuth drive amplifiers 122. These drive amplifiers 122 power the azimuth servomotors 56, 58 and elevation servomotor 68 and the requisite tachometers.

Figures 11A, 11B, 11C:
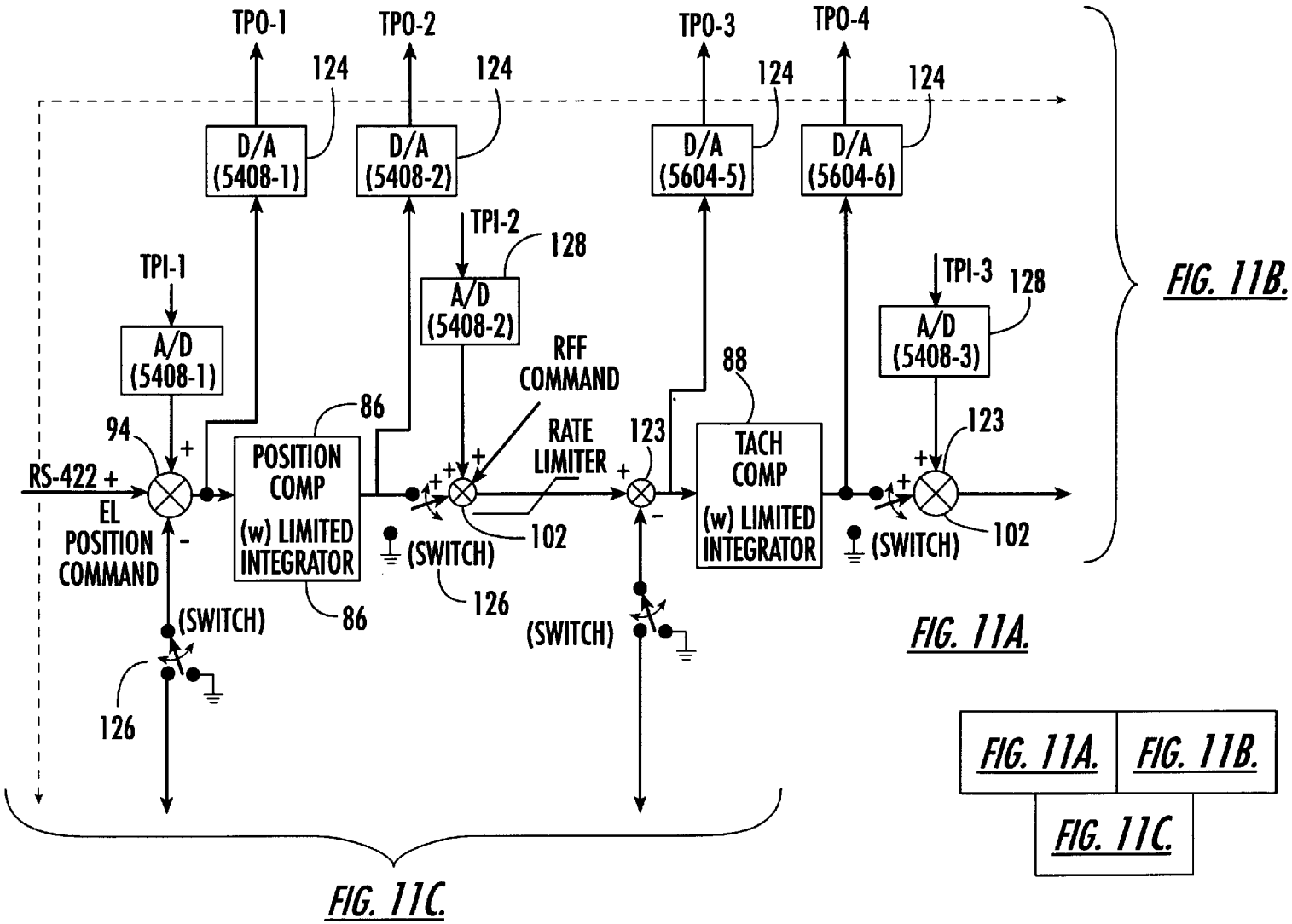
FIG. 11 is a more detailed block diagram of the elevation control circuit used with the antenna control unit.
Figures 11A, 11B, 11C:
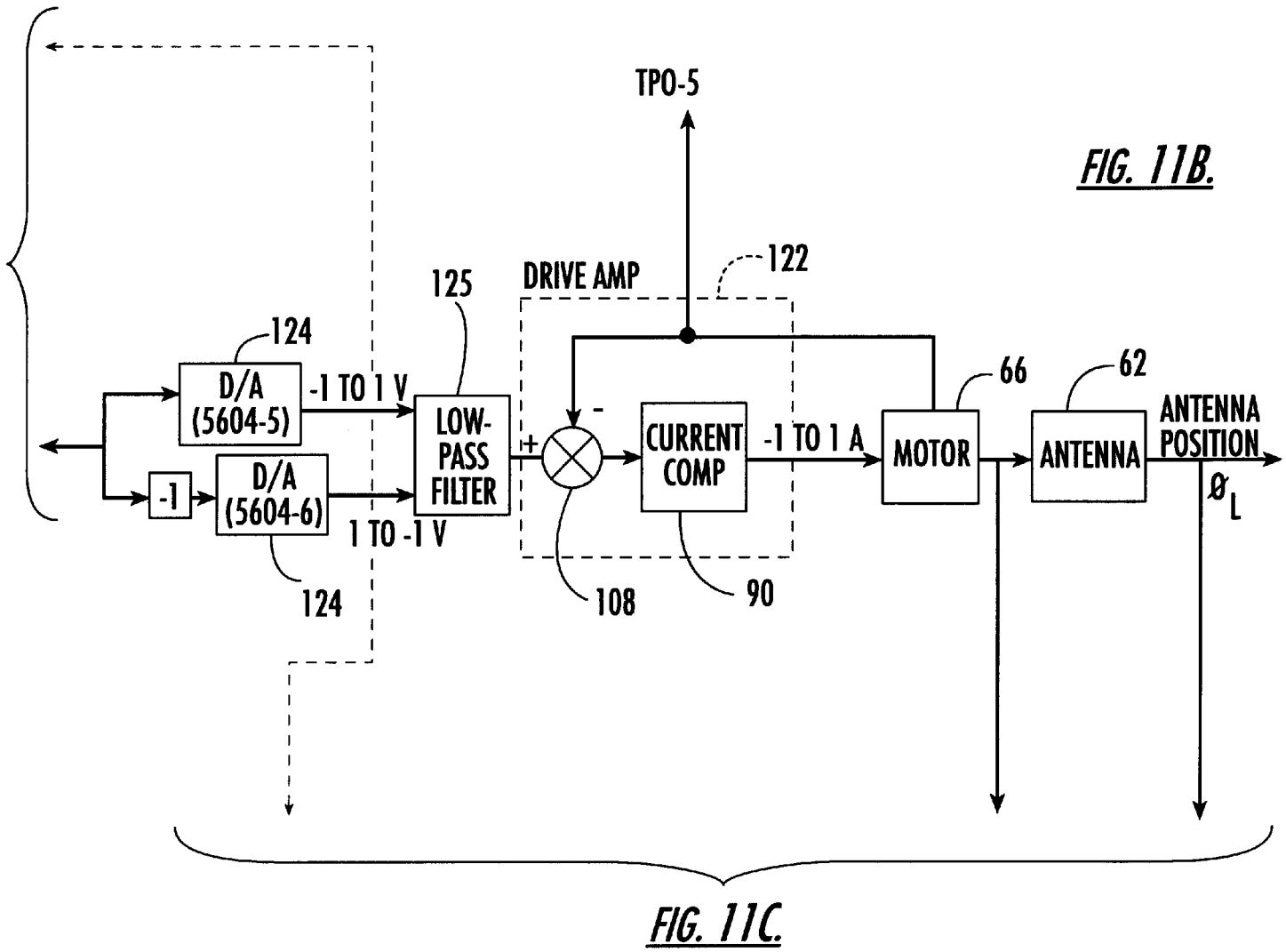
Figures 11A, 11B, 11C:
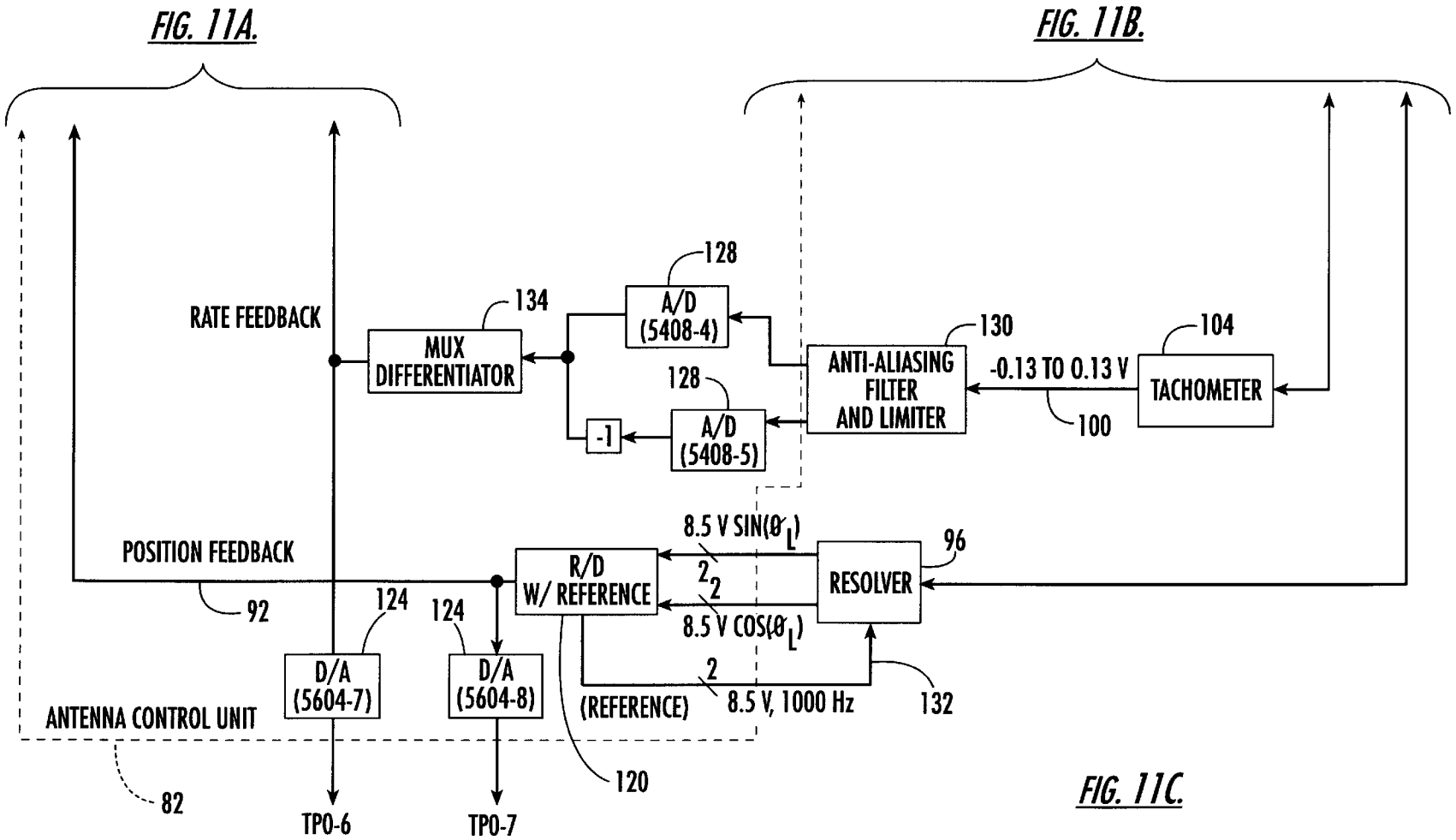
Figures 12A, 12B, 12C, 12D:
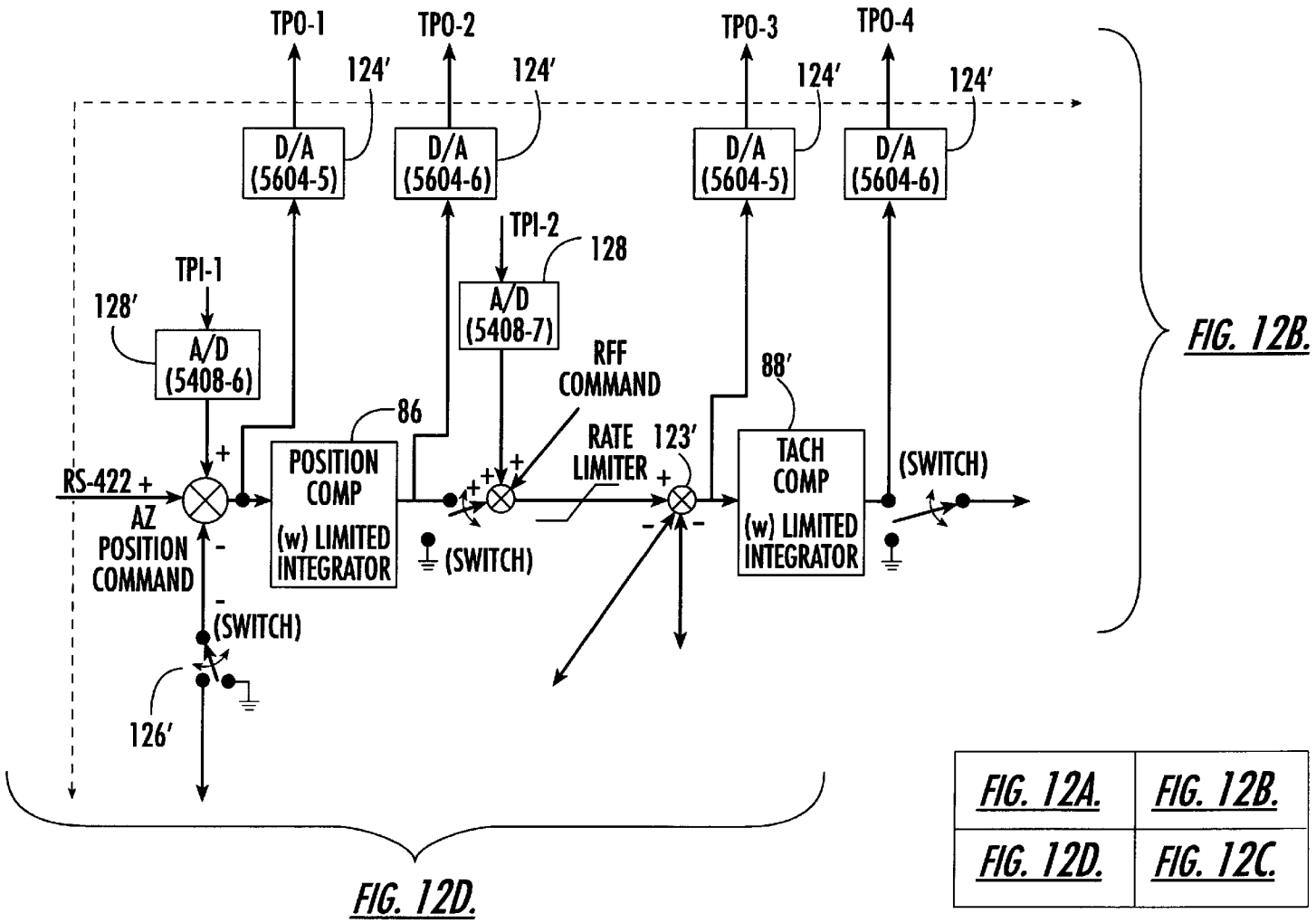
FIG. 12 is a more detailed block diagram of the azimuth control circuit used with the antenna control unit.
Figures 12A, 12B, 12C:
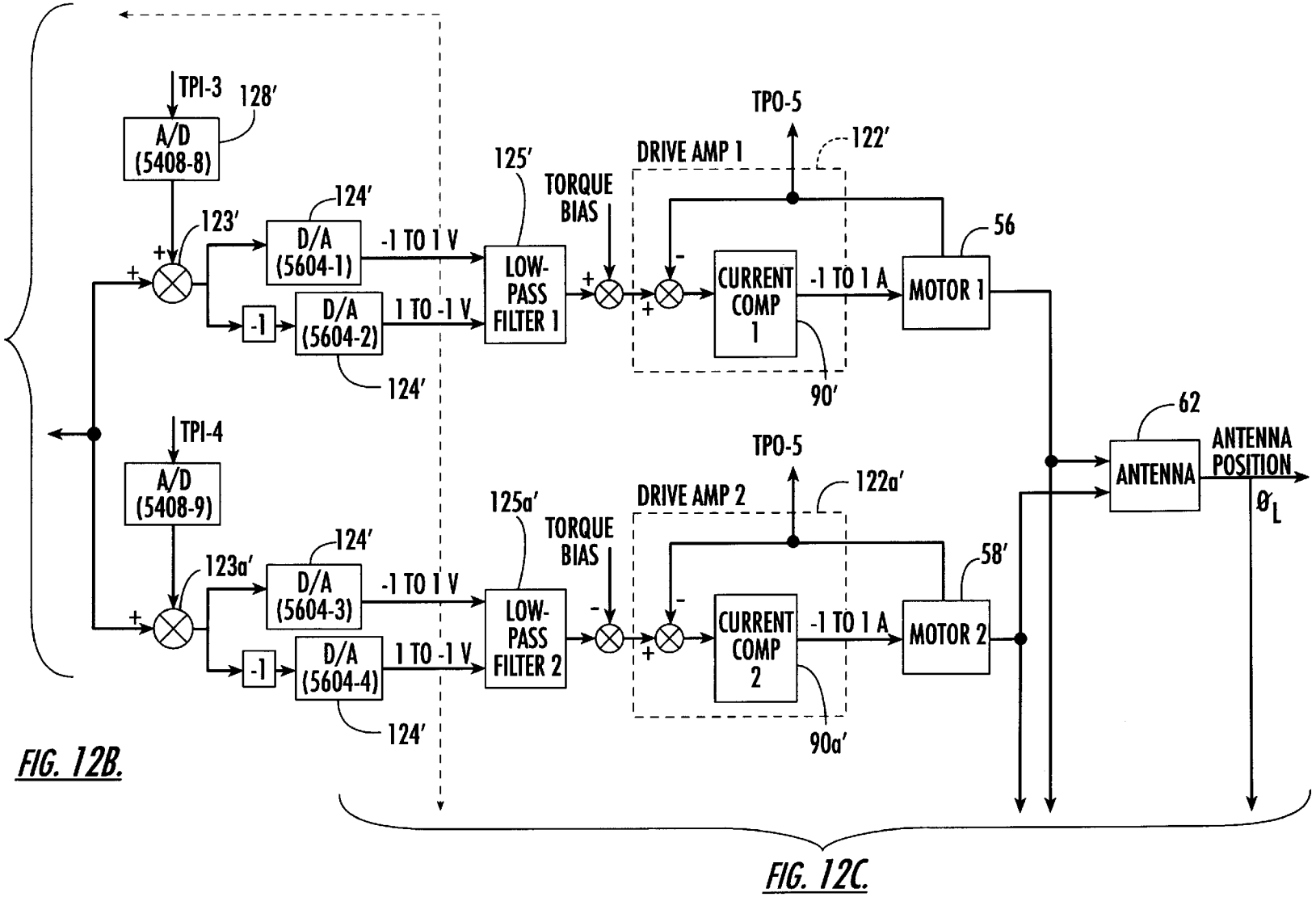
Figures 12A, 12B, 12C, 12D:
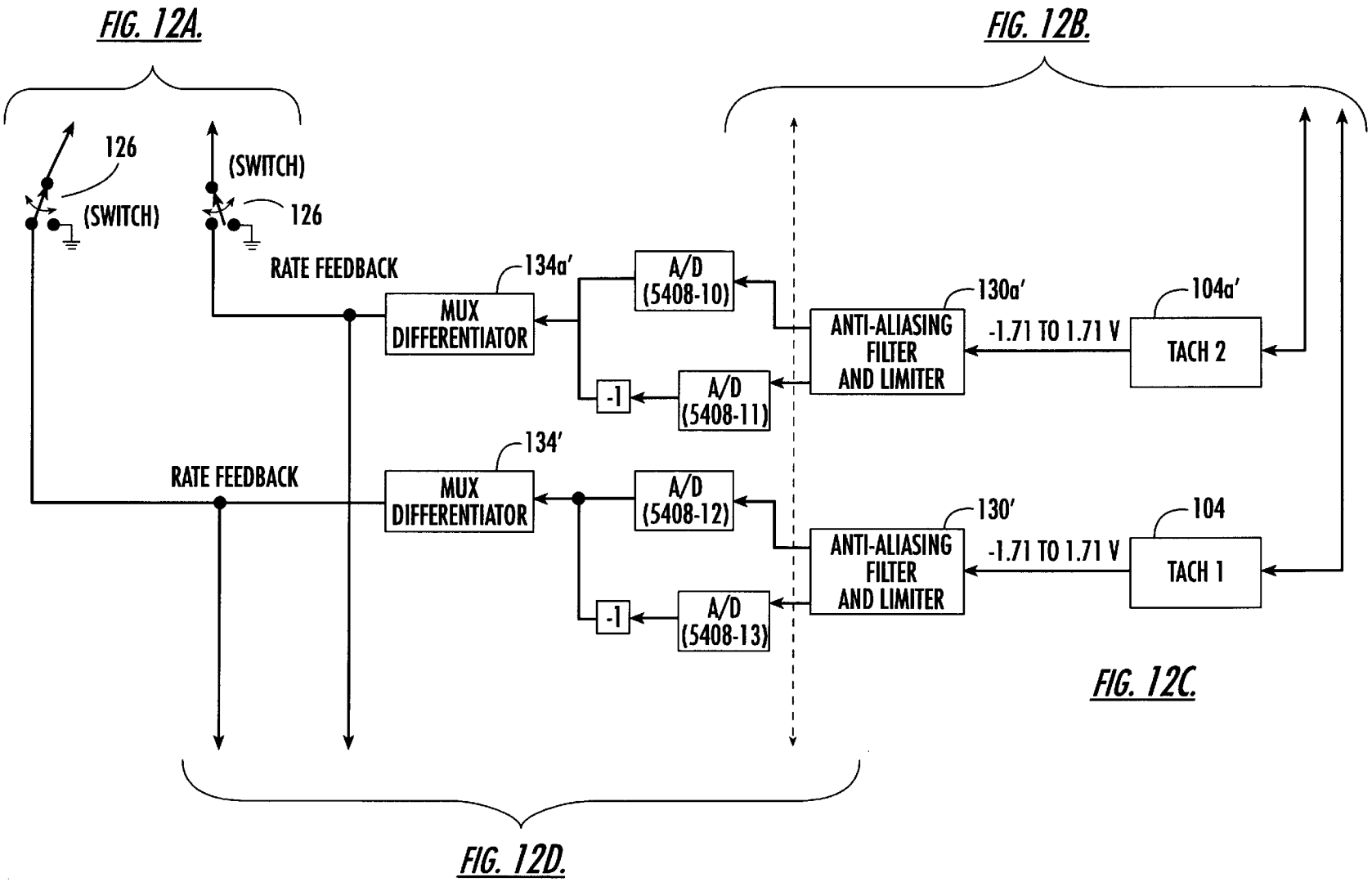
Figures 12A, 12B, 12C, 12D:
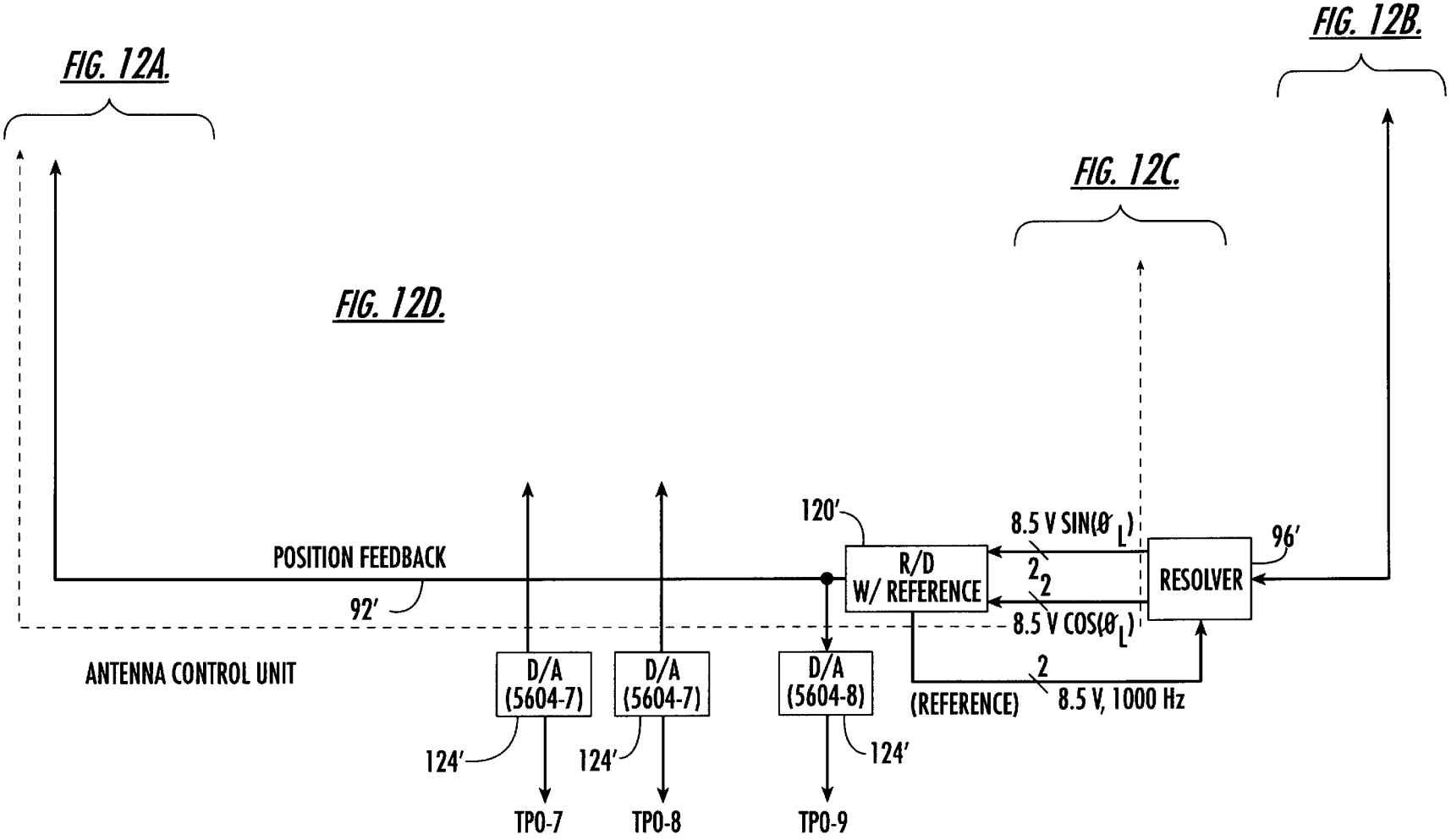

FIGS. 11 and 12 illustrate more detailed block diagrams of the antenna control unit 82, including the elevation control circuit (FIG. 11) and the azimuth control circuit (FIG. 12). The block diagrams illustrate the various digital/analog converters 124 and illustrate the rate feed forward command to the respective mixer/summer 94, 94'. Similar elements are given similar reference numerals with prime notation as noted before. Additional mixer/summers are given reference numeral 123. Appropriate switches 126, 126' and analog/digital converters 128, 128' are illustrated. Low pass filter 125 is positioned between the tachometer compensator and the current compensator. The tachometer for each of the elevation and azimuth control circuits in the rate feedback control loop also includes an anti-aliasing filter and limiter 130, 130'. Each resolver 96, 96' also inputs to the resolver/digital module 120, with the reference, which also includes a feedback loop 132, 132'. The anti-aliasing filters and limiters input into analog-to-digital converters and multiplexer differentiators 134, 134' as part of the rate feedback control loop.

In operation, the positioners are slaved to pointing commands. Each pointing command can be in pedestal coordinates as an elevation or an azimuth, angle. The motor feedback control loops 106, 106', 106*a*' will typically act as a current or acceleration loop, and have a transconductance amplifier driving the respective servomotor. A current loop bandwidth should be at a minimum of about 1.0 KHZ, as typified by a drive amplifier specification as required by those skilled in the art. In both elevation and azimuth axes, the rate feedback control loop 100, 100' is closed about the tachometer 104, 104', 104*a*' and provides voltage commands to the motor feedback control loop also acting as a motor current feedback loop. This type of loop should be implemented as a type 1 loop.

The position compensator 86, 86' provides velocity commands to the rate feedback control loop 100, 100'. The position feedback control loop 92, 92' is closed about the rate feedback control loop 100, 100' by the resolver 96, 96'. The position feedback control loop 92, 92' can be implemented as either a type 1 loop or a type 2 loop. The rate feed forward command generated by the Antenna Control System 84 increases the responsiveness of the system by bypassing the lower bandwidth position feedback control loop 92, 92' and injecting a command directly into the higher bandwidth rate feedback control loop 100, 100'. A baud rate between the antenna control system 82 and the antenna control unit 82 can be specified as about 9.2 Kbaud. The antenna control system 84 also provides pointing commands to the antenna control unit 82.

This patent application is related to commonly assigned, co-pending patent application entitled "LOW PROFILE ANTENNA POSITIONER FOR ADJUSTING ELEVATION AND AZIMUTH" filed on the same date of the present application by the same inventors.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An antenna positioner control system comprising:

a housing;

a hub mounted within the housing;

a support plate rotatably mounted on the hub;

an antenna pivotally mounted on the support plate;

at least one elevation drive servomotor mounted on the support plate and interconnecting the antenna for pivoting the antenna a predetermined angle and adjusting elevation of the antenna;

at least one azimuth drive servomotor mounted on the support plate and interconnecting the antenna for rotating the support plate relative to the hub a predetermined arcuate distance for adjusting azimuth of the antenna;

an antenna control unit operatively connected to said elevation drive servomotor and azimuth drive servomotor, said antenna control unit further comprising:

an elevation control circuit operatively connected to the elevation drive servomotor for adjusting elevation;

an azimuth control circuit operatively connected to the azimuth drive servomotor for adjusting the azimuth angle of the antenna;

each of said control circuits including a position feedback control loop, a resolver positioned within said position feedback control loop, a rate feedback control loop and a tachometer positioned within said rate feedback control loop, and a motor feedback control loop.

2. An antenna positioner control system according to claim 1, and further comprising a current compensator positioned within the motor feedback control loop.

3. An antenna positioner control system according to claim 1, and further comprising a position compensator positioned within the position feedback control loop.

4. An antenna positioner control system according to claim 1, and further comprising a tachometer compensator positioned within the rate feedback control loop.

5. An antenna positioner control system according to claim 1, and further comprising an antenna subsystem controller operatively connected to said antenna control unit, wherein said antenna subsystem controller further comprises a circuit for generating azimuth and elevation pointing commands to the antenna control unit.

6. An antenna positioner control system according to claim 1, wherein said antenna further comprises a phased array antenna.

7. An antenna positioner control system according to claim 1, and further comprising an antenna support shaft mounted on said antenna such that rotation of said support shaft pivots the antenna and adjusts elevation, wherein said elevation servomotor is operatively connected to said support shaft.

8. An antenna positioner control system according to claim 7, wherein said elevation drive servomotor includes an output shaft and a drive mechanism operatively interconnecting said output shaft and a drive shaft.

9. An antenna positioner control system comprising:

an annular configured housing;

a central hub mounted within the annular configured housing and having a ring gear mounted thereon;

a substantially planar configured support plate rotatably mounted on the central hub within the annular configured housing;

an antenna pivotally mounted on the support plate;

at least one elevation drive servomotor mounted on the support plate and interconnecting the antenna for pivoting the antenna a predetermined angle and adjusting elevation of the antenna;

two azimuth drive servomotors mounted on the support plate, each having an output shaft and a pinion gear mounted on the output shaft that engages the ring gear for rotating the support plate relative to the hub and having a predetermined arcuate distance for adjusting azimuth of the antenna;

an antenna control unit operatively connected to said elevation drive servomotor and azimuth drive servomotors, said antenna control unit further comprising:

an elevation control circuit operatively connected to the elevation drive servomotor for adjusting elevation;

an azimuth control circuit operatively connected to the azimuth drive servomotors for adjusting the azimuth angle of the antenna;

each of said control circuits including a resolver positioned within a position feedback control loop, a tachometer positioned within a rate feedback control loop, and a motor feedback control loop.

10. An antenna positioner control system according to claim 9, wherein said antenna control unit includes a circuit for generating a rate feed forward command to each of said azimuth drive and elevation drive servomotors corresponding to an anticipated velocity position.

11. An antenna positioner control system according to claim 9, and further comprising a current compensator positioned within the motor feedback control loop.

12. An antenna positioner control system according to claim 9, and further comprising a position compensator positioned within the position feedback control loop.

13. An antenna positioner control system according to claim 9, and further comprising a tachometer compensator positioned within the rate feedback control loop.

14. An antenna positioner control system according to claim 9, and further comprising an antenna subsystem controller operatively connected to said antenna control unit, wherein said antenna subsystem controller further comprises a circuit for generating azimuth and elevation pointing commands to the antenna control unit.

15. An antenna positioner control system according to claim 9, wherein said antenna further comprises a phased array antenna.

16. An antenna positioner control system according to claim 9, and further comprising an antenna support shaft mounted on said antenna such that rotation of said support shaft pivots the antenna and adjusts elevation, wherein said elevation drive servomotor is operatively connected to said support shaft.

17. An antenna positioner control system according to claim 16, wherein said elevation drive servomotor includes a drive mechanism connected to a drive shaft.

18. An antenna positioner control system comprising:

a housing;

a hub mounted within the housing;

a support plate rotatably mounted on the hub;

an antenna pivotally mounted on the support plate;

at least one elevation drive servomotor mounted on the support plate and interconnecting the antenna for pivoting the antenna a predetermined angle and adjusting elevation of the antenna;

at least one azimuth drive servomotor mounted on the support plate and interconnecting the antenna for rotating the support plate relative to the hub and having a predetermined arcuate distance for adjusting azimuth of the antenna;

an antenna control unit operatively connected to said elevation drive servomotor and azimuth drive servomotor, said antenna control unit further comprising:

an elevation control circuit operatively connected to the elevation drive servomotor for adjusting elevation;

an azimuth control circuit operatively connected to the azimuth drive servomotor for adjusting the azimuth angle of the antenna;

each of said control circuits including a resolver positioned within a position feedback control loop, a rate feedback control loop and a tachometer positioned within said rate feedback control loop, and a motor feedback control loop; and a circuit for generating a rate feed forward command to each of said azimuth drive and elevation drive servomotors corresponding to an anticipated velocity position.

19. An antenna positioner control system according to claim 18, and further comprising a current compensator positioned within the motor feedback control loop.

20. An antenna positioner control system according to claim 18, and further comprising a position compensator positioned within position feedback loop.

21. An antenna positioner control system according to claim 18, and further comprising a tachometer compensator positioned within the rate feedback control loop.

22. An antenna positioner control system according to claim 18, and further comprising an antenna subsystem controller operatively connected to said antenna control unit, wherein said antenna subsystem controller further comprises a circuit for generating azimuth and elevation pointing commands to the antenna control unit.

23. An antenna positioner control system according to claim 18, wherein said antenna further comprises a phased array antenna.

24. An antenna positioner control system according to claim 18, and further comprising an antenna support shaft mounted on said antenna such that rotation of said support shaft pivots the antenna and adjusts elevation, wherein said elevation drive servomotor is operatively connected to said support shaft.

25. An antenna positioner control system according to claim 18, wherein said elevation drive servomotor includes an output shaft and a drive mechanism connected to said support shaft and said output shaft of said elevation drive servomotor.

26. A method of controlling azimuth and elevation of an antenna comprising the steps of:

providing a hub mounted within a housing, and a support plate rotatably mounted on the hub wherein an antenna is pivotally mounted on the support plate;

generating an azimuth pointing command and elevation pointing command within respective azimuth and elevation control circuits to respective azimuth and elevation drive servomotors;

driving the respective azimuth and elevation drive servomotors through respective azimuth and elevation current acceleration loops;

generating respective azimuth and elevation voltage commands to the respective current acceleration loops through respective tachometer rate loops that are closed about respective azimuth and elevation tachometers; and generating respective azimuth and elevation velocity commands to the respective tachometer rate loops through respective azimuth and elevation position loops.

27. A method according to claim 26, and further comprising the step of closing the respective azimuth and elevation position loops about the tachometer rate loops through the use of resolvers.

28. A method according to claim 26, and further comprising the step of generating a rate feed forward command to increase the responsiveness of the respective circuits by bypassing a lower bandwidth position loop and injecting a command directly into a higher-bandwidth tachometer rate loop.

* * * * *